US011965390B2

(12) United States Patent
Maciver et al.

(10) Patent No.: US 11,965,390 B2
(45) Date of Patent: Apr. 23, 2024

(54) COMBINED MASTER VALVE AND CABLE HANGER FOR DEPLOYING ELECTRIC SUBMERSIBLE PUMP IN A LIVE WELL

(71) Applicant: Schlumberger Technology Corporation, Sugar Land, TX (US)

(72) Inventors: Ivor Maciver, Aberdeen (GB); Norman Liley, Aberdeen (GB); Iain Maclean, Aberdeen (GB); Calum Crawford, Aberdeen (GB)

(73) Assignee: Schlumberger Technology Corporation, Sugar Land, AS (US)

( * ) Notice: Subject to any disclaimer, the term of this patent is extended or adjusted under 35 U.S.C. 154(b) by 0 days.

(21) Appl. No.: 18/004,918

(22) PCT Filed: Jul. 1, 2021

(86) PCT No.: PCT/EP2021/068250

§ 371 (c)(1),
(2) Date: Jan. 10, 2023

(87) PCT Pub. No.: WO2022/008350

PCT Pub. Date: Jan. 13, 2022

(65) Prior Publication Data

US 2023/0243228 A1 Aug. 3, 2023

Related U.S. Application Data

(60) Provisional application No. 63/050,153, filed on Jul. 10, 2020.

(51) Int. Cl.

| | |
|---|---|
| ***E21B 33/072*** | (2006.01) |
| ***E21B 17/02*** | (2006.01) |
| ***E21B 34/02*** | (2006.01) |
| ***E21B 47/12*** | (2012.01) |

(52) U.S. Cl.

CPC ..... *E21B 33/072* (2013.01); *E21B 17/028* (2013.01); *E21B 34/02* (2013.01); *E21B 47/12* (2013.01)

(58) Field of Classification Search

CPC .... E21B 33/04; E21B 33/0407; E21B 33/068; E21B 33/072; E21B 34/02; E21B 34/025

See application file for complete search history.

(56) References Cited

U.S. PATENT DOCUMENTS

2009/0272522 A1* 11/2009 Ring ..... E21B 33/04 166/86.1

2011/0036596 A1* 2/2011 Nguyen ..... E21B 33/12 166/386

* cited by examiner

*Primary Examiner* — Kristyn A Hall

(74) *Attorney, Agent, or Firm* — Jeffrey D. Frantz

(57) ABSTRACT

Master valve and cable hanger system for deploying and making electrical connection to an electric submersible pump. A landing for the cable hanger (50) is in the through bore below the valve closure element. The landing has a seal area and a bore transverse to the through bore penetrating into the seal area for allowing electric connection to the pump. The cable hanger has a seal section having longitudinally spaced apart seals engageable with an interior of the seal area, electrical contacts disposed between the seals, and a lockdown profile. Flow ports are arranged to bypass seal area and seal section. A blanking plug (58) is disposed in the transverse bore to seal the seal area prior to insertion of the cable hanger.

15 Claims, 10 Drawing Sheets

COMBINED MASTER VALVE AND CABLE HANGER FOR DEPLOYING ELECTRIC SUBMERSIBLE PUMP IN A LIVE WELL

CROSS-REFERENCE TO RELATED APPLICATIONS

This application is a National Stage Entry of International Application No. PCT/EP2021/068250, filed Jul. 1, 2021, which claims the benefit of U.S. Provisional Patent Application No. 63/050,153, filed Jul. 10, 2020.

BACKGROUND

This disclosure relates to the field of well tools, in particular, electrically operated tools such as submersible well pumps, e.g., electric submersible pumps (ESPs). With more particularity, the disclosure relates to methods for deploying cable-conveyed well tools such as through-tubing ESPs without the need to "kill" a well that has produced fluid from the subsurface or is fully prepared for such production.

Well pumps such as sucker rod pumps and ESPs are used on subsurface fluid producing wells when natural pressure in a subsurface reservoir formation is insufficient to lift useful fluids, e.g., oil and gas, to surface. Such pressure may be the result of depletion of natural pressure as fluid is produced, insufficient original pressure or hydrostatic loading caused by water being produced from the reservoir into the well so as to counteract the reservoir pressure.

In cases, for example. where a well has been producing fluid and later deployment of a pump is required, in cases where a well already has a pump but the pump has failed, or in cases where a well is fully prepared (including hydraulic connection to the producing reservoir formation) for production prior to installing a pump, using methods known in the art to deploy a pump on such a "live" well typically requires "killing" the well, thus making it unable to move fluid to surface even inadvertently. Killing a live well may be performed, e.g., by displacing fluid present in the well with high density "kill" fluid to exert enough hydrostatic pressure such that reservoir formation pressure is essentially unable to move fluid to surface. Killing a well can be difficult and expensive, and requires transport to the well of pumping equipment, storage for kill fluid and associated pressure control equipment to perform the fluid displacement safely. The high density "kill" fluid can also cause a reduction in permeability in the near-wellbore area such as by the displacement of debris that plugs the perforations (in the production casing or liner) or the pore spaces within the formation matrix (rock mineral grains), thus reducing the productivity of the well. Killing a well is therefore undesirable.

U.S. Pat. No. 10,036,210 issued to Maclean et al. discloses a method for deploying an ESP through the production tubing on a tubing encapsulated electrical cable. The deployment cable is also used to provide power to the ESP and to communicate control signals from surface to the ESP and any data signals from the ESP to surface and thus may remain in the well after ESP deployment. Such method may enable retrofit of an ESP in a well that has a failed pump deployed on the production tubing, but the disclosed method may still require killing the well for such deployment depending on how the cable exits the well in the wellhead area.

Other methods for installation, maintenance and repair of cable deployed through tubing well pumps may require removing a surface control and safety valve assembly ("tree").

It is desirable to have a system for installing a well tool such as an ESP in a "live" well without the need to kill the well, or the need for adjusting the flowlines, or the need to adjust flow lines connected to a well tree.

SUMMARY

One aspect of the present disclosure is a valve and cable hanger system for deploying and making electrical connection to a well tool. A system according to this aspect of the disclosure includes a valve body having a through bore. A valve closure element is arranged to close the through bore. A landing for a cable hanger is in the through bore to one side of the valve closure element. For example, a landing for a cable hanger may be below the valve closure element. The landing has a seal area and a bore transverse to the through bore penetrating into the seal area. The cable hanger has a seal section having longitudinally spaced apart seals engageable with an interior of the seal area, electrical contacts disposed between the seals, and a lockdown profile. A flow port is arranged to bypass the seal section, and penetrates at least one of the seal section and the seal area. A lockdown screw is disposed within the valve body between the seals and to engage the lockdown profile. A blanking plug is disposed in the transverse bore to seal the seal area prior to insertion of the cable hanger.

Some examples may further comprise an orienting tool coupled to one end of the cable hanger, the orienting tool comprising at least one helically shaped orienting tulip.

Some examples may further comprise an orienting screw disposed within the valve body an extending into the through bore on a side of the valve closure element opposed to the seal area, the orienting screw extending into the through bore to engage the at least one orienting tulip.

The at least one flow port may be disposed in the valve body proximate the seal area, the orienting tool further comprising an orienting pin shaped to engage the at least one flow port in the valve body.

The orienting tool may be coupled to the cable hanger by a release mechanism enabling uncoupling the orienting tool from the cable hanger.

The release mechanism comprises a device having a selected failure tension or compression.

Some examples may further comprise a penetrator having electrical contacts at one end and sealingly disposable within the transverse bore, the electrical contacts engageable with the electrical contacts in the seal section.

The valve closure element may comprise a valve gate and gate seats.

A method for installing well tool in a well according to another aspect of the disclosure includes installing a plug, or plugs, in the well below a well tree. An upper master valve and a lower master valve on the well tree are closed. The lower master valve is replaced with a replacement master valve. The replacement master valve has a landing for a cable hanger in the through bore to one side of a valve closure element. The landing comprises a seal area and a bore transverse to the through bore penetrating into the seal area. The upper master valve is opened. The plug is removed, and the well tool is extended into the well on the end of an electrical cable. The cable hanger is affixed to the electrical cable and the cable hanger is seated in the seal area. The cable hanger comprises sealing elements to engage the seal area and an electrical connector. The electrical connector is oriented to enable access through a horizontal bore in the seal area.

The sealing elements on the cable hanger may close the transverse bore to fluid flow when the cable hanger is disposed in the seal area.

Installing the plug, extending the well tool into the well and the affixing the cable hanger may be performed by affixing a blowout preventer and lubricator to the well tree after closing the upper master valve.

Some examples may further comprise inserting a packer into the well after removing the plug and prior to extending the well tool.

The electrical cable may comprise a tubing encapsulated cable.

Some examples may further comprise making electrical connection to the electrical connector and operating the well tool.

Some examples may further comprise affixing at least one of a plug and a back pressure valve in a profile in an upper one of the gate seats, the upper one of the gate seats disposed in a through bore in the master valve.

Other aspects and possible advantages will be apparent from the description and claims that follow.

DETAILED DESCRIPTION

Figure 1:
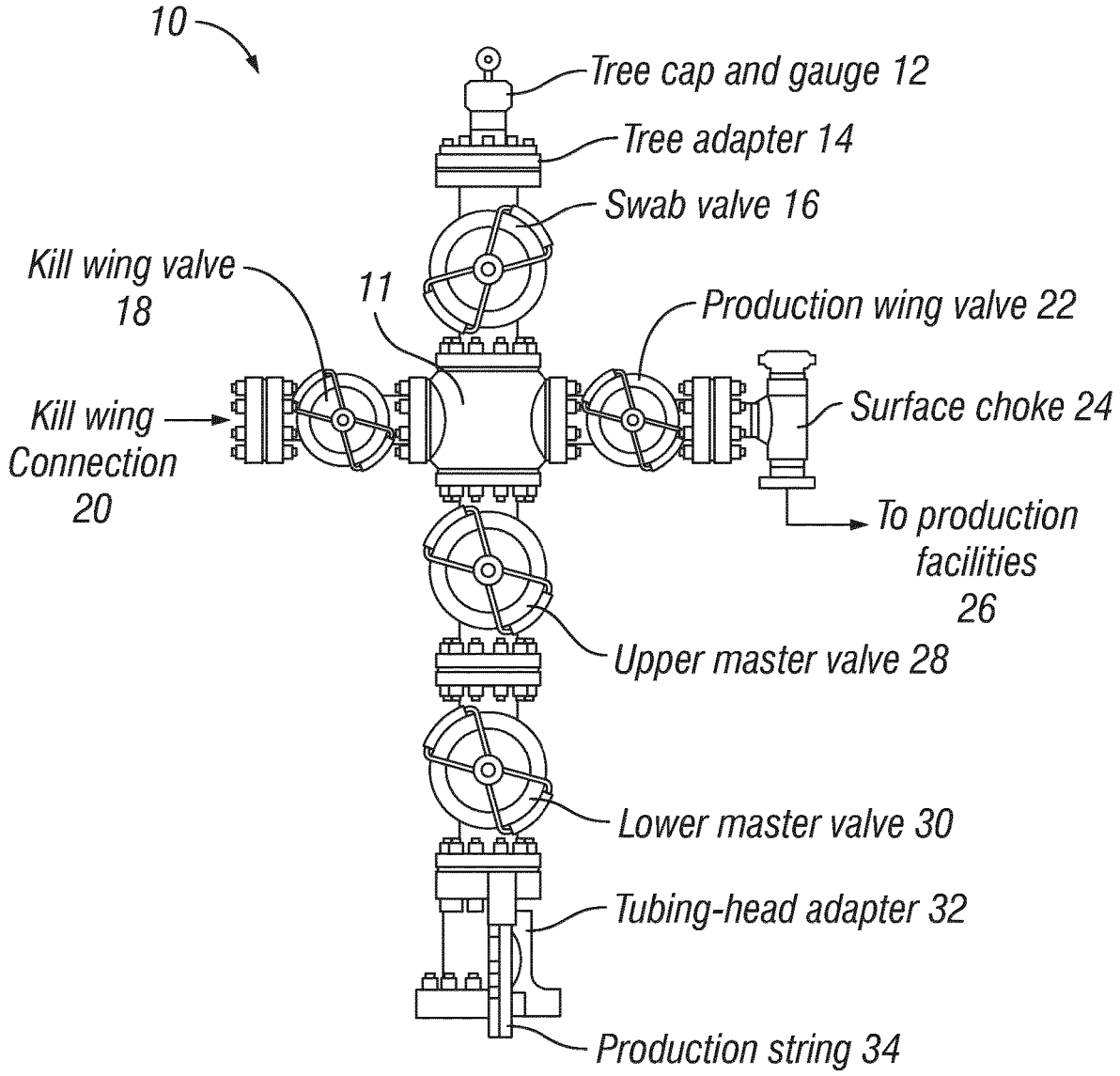
FIG. 1A shows a flanged type well control valve assembly ("tree") having master valves, the tree being usable in methods according to the present disclosure.

FIG. 1 shows an example embodiment of a well surface control valve assembly ("tree") 10 that may be used in accordance with methods set forth in the present disclosure. The tree 10 shown in FIG. 1 is a "flanged" tree that may be assembled from flange-coupled individual components, for example, a tree cap and pressure gauge 12 at an uppermost end of the tree 10, beneath which may be flange coupled, in order of their illustration vertically, a tree adapter 14, swab valve 16, adapter 11, upper master valve 28, lower master valve 30, tubing head adapter 32 and the upper end of a production tubing string 34 (internal to the tubing head adapter 32). The adapter 11 may have, on its respective side ports a kill wing valve 18 and associated kill line connection 20, a production wing valve 22 and associated connection to a choke 24 and connector to a flow line 26. Methods according to the present disclosure may begin by closing the master valves 28, 30, wing valves 18, 22 and removing the tree adapter 14, and cap and pressure gauge 12 from the tree 10. Although the description of components of a master valve according to the present disclosure below are made in terms of a flanged tree, it should be clearly understood that a master valve according to the present disclosure may form part of a "monoblock" tree, in which flow control valves are disposed in a unitary housing. Accordingly, the present disclosure is not limited in scope to a flanged tree.

Figure 2A:
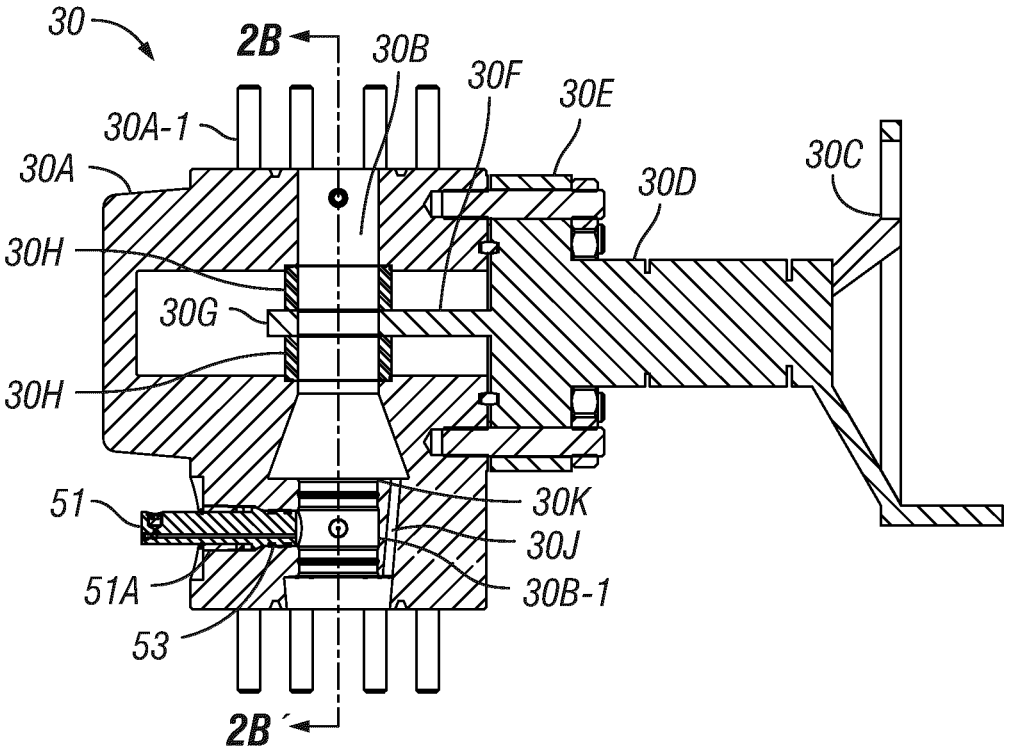
FIGS. 2A, 2B and 2C show various views of a master valve.
Figure 2B:
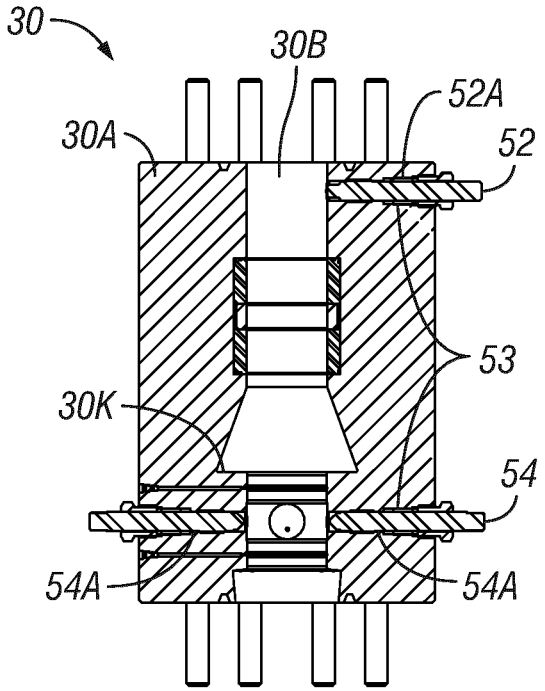
Figure 2C:
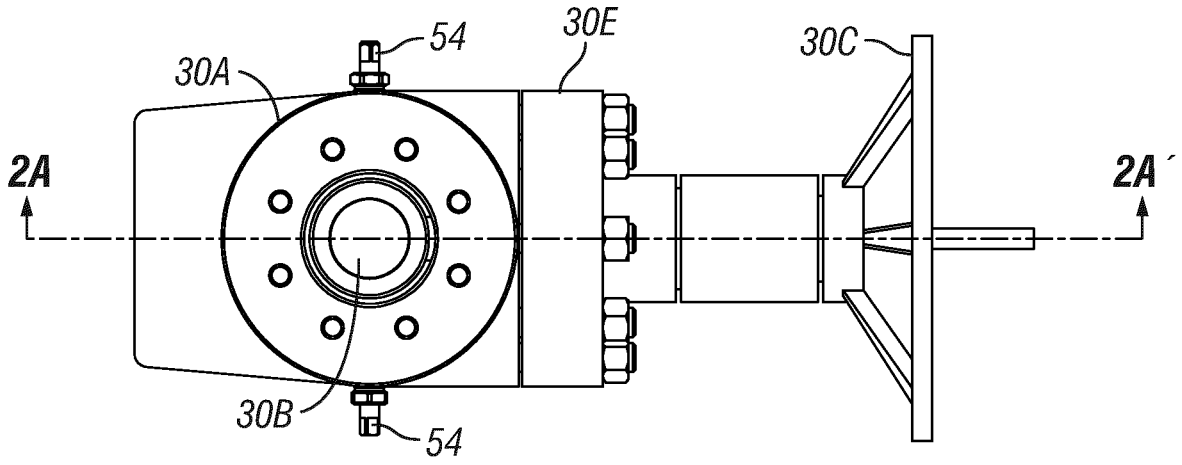

FIGS. 2A, 2B and 2C show a lower master valve 30 in a tree such as in FIG. 1, in side cross-section, side cross-section rotated 90 degrees, and a top view, respectively. It will be appreciated that the lower master valve 30 shown in FIGS. 2A, 2B and 2C may be structurally similar to a lower master valve in a monoblock tree, differences including that a valve body will not be a separate component from the unitary housing of the monoblock tree. The lower master valve 30 may be made by assembling certain components into a valve body 30A (noting the foregoing statement concerning a monoblock tree). The valve body 30A has formed therein a through bore 30B for flow of fluid and movement of components, tools and equipment into and out of a well (not shown in the figures) that extends below the tree (10 in FIG. 1). The valve body 30A may couple to other components of the tree (10 in FIG. 1) using threaded studs 30A-1 along a mounting surface, or, in some embodiments the valve body 30A may comprise flanges (not shown) to couple the valve body 30A to adjacent components, again with the understanding that in a monoblock tree no such coupling devices will be disposed on one side of the lower master valve 30. In a monoblock tree, however, the lower couplings shown in FIGS. 2A and 2B may be present in some embodiments to connect such monoblock tree to the well.

A bonnet 30E may couple a valve closure element, which in the present embodiment may be a gate valve assembly, to the valve body 30A. The gate valve assembly may comprise a hand wheel 30C or actuator (not shown) coupled to a threaded valve stem 30F. The valve stem 30F is engaged by threads within a gate block 30D held in the valve body 30A by the bonnet 30E. Gate seats 30H fit in the through bore 30B, inserted through a horizontal bore under the bonnet 30E, to seal a gate 30G that is moved across the through bore 30B and retracted therefrom by operation of the valve stem 30F. In these respects, the lower master valve 30 may be structured similarly to and operate similarly to any valve known in the art used in a well tree.

The through bore 30B may comprise, below the lower gate seat 30H, a narrower diameter (that is, narrower than the diameter of the through bore 30B) landing 30K for a cable hanger (not shown in FIG. 2A, 2B or 2C; described below with reference to FIGS. 3A, 3B and 3C) to rest upon so as to transfer axial load from the cable hanger (not shown) to the valve body 30A. The through bore 30B may comprise, below the landing 30K, a generally cylindrically shaped seal area 30B-1 for seals on the exterior of the cable hanger (not shown) to engage sealingly when the cable hanger (not shown) is disposed in the valve body 30A. The seal area 30B-1 may comprise one or more bypass ports 30J to enable fluid flow around the seal area 30B-1 within the through bore 30B when the cable hanger (not shown) is seated in the seal area 30B-1. A bore MA transverse (hereinafter "transverse bore") to the through bore 30B and penetrating into the seal area 30B-1 provides a place for a blanking plug 51, and as will be further explained below, an electrical connector (not shown in FIGS. 2A and 2B). The transverse bore 51A may be closed by having a blanking plug 51 disposed in the transverse bore 51A during installation of the cable hanger, and during the initial part of installation of a well tool such as an electric submersible pump (ESP) in the well. The blanking plug 51 may be sealed within the transverse bore 51A using any type of conventional seal 53 known to be used for such purpose, such as, without limitation, o-rings or packing. As will be explained further below, once the cable hanger (not shown) is seated in the seal area 30B-1, the transverse bore 51A is fluidly isolated from the through bore 30B and the blanking plug 51 may be removed safely.

In the view of FIG. 2B, which is rotated 90 degrees from the view in FIG. 2A, it may be observed that the valve body 30A may comprise a hanger orientation screw 52 disposed in a corresponding orientation screw bore 52A above the upper gate seat 30H. The orientation screw bore 52A may be sealed using a packing gland or similar seal known in the art. The hanger orientation screw 52 may be inserted to enable orienting the cable hanger (not shown) during installation and may be retracted enough to clear the through bore 30B to facilitate other operations at other times, as will be further explained below. Cable hanger lockdown screws 54 may be inserted into the valve body 30A through corresponding lockdown screw bores 54A below the lower gate seat 30H, which lockdown screw bores 54A may be essentially co-planar with the transverse bore (51A in FIG. 3A). The lockdown screws 54 may be sealed within their bores 54A in a manner similar to the orientation screw 52.

A top view of the lower master valve 30 in FIG. 2C shows the through bore 30B for reference as well as the lockdown screws 54 and orientation screw 52 when inserted into their respective bores.

A cable hanger will now be explained with reference to FIGS. 3A, 3B and 3C. In a cross-sectional view in FIG. 3A, the cable hanger 50 may comprise, all within a pressure sealed housing 50F, slips 50J or other device to transfer axial load on a cable 60, such as a tubing encapsulated cable or an armored electrical cable, to the housing 50F. A splice connector 50E may make electrical connection between one or more insulated electrical conductors (not shown) in the cable 60 to an electrical contact device called a vertical penetrator 50H. The vertical penetrator 50H is disposed within that part of the housing 50F that extends through the seal area (30B-1 in FIG. 2A) and has transversely oriented electrical contacts 50B-1 located longitudinally such that the electrical contacts 50B-1 are disposed within the longitudinal position of the transverse bore (51A in FIG. 2A) when the cable hanger 50 is seated in the seal area (30B-1 in FIG. 2A). During installation procedures, prior to seating the cable hanger 50, a running blanking plug 50B may be inserted to cover and seal the electrical contacts 50B-1, such running blanking plug 50B to be removed to make electrical connection to the electrical contacts 50B-1, as will be further explained below.

The housing 50F may comprise at its upper end a fishing neck 50A or similar feature to enable connection of a running tool during insertion into and removal of the cable hanger 50 from the lower master valve (30 in FIG. 1). The fishing neck 50A may extend into a seal section 50A-1 that is larger in diameter than the housing 50A and longitudinally extends in both directions beyond the electrical contacts 50B-1. The seal section 50A-1 may comprise on its outer surface, longitudinally spaced apart seals 50D, for example, o-rings, that engage the interior surface of the seal area (30B-1 in FIG. 2A) in the valve body (30A in FIG. 2A), thereby excluding fluid in the through bore (30B in FIG. 2A) from the transverse bore (51A in FIG. 2A) and the electrical contacts 50B-1. A shoulder 50J of slightly larger diameter than the nominal diameter of the seal section 50A-1 engages the landing (30K in FIG. 2A) to stop longitudinal movement of the cable hanger 50 when it is in its seated position in the valve body (30A in FIG. 2A). The seal section 50A-1 may comprise one or more flow ports 50C that enable axial fluid movement through the seal area (30B-1 in FIG. 2A), thus enabling fluid movement longitudinally through the valve body (30A in FIG. 2A) while leaving the transverse bore (51A in FIG. 2A) fluidly isolated from the through bore (30B in FIG. 2A).

Figure 3A:
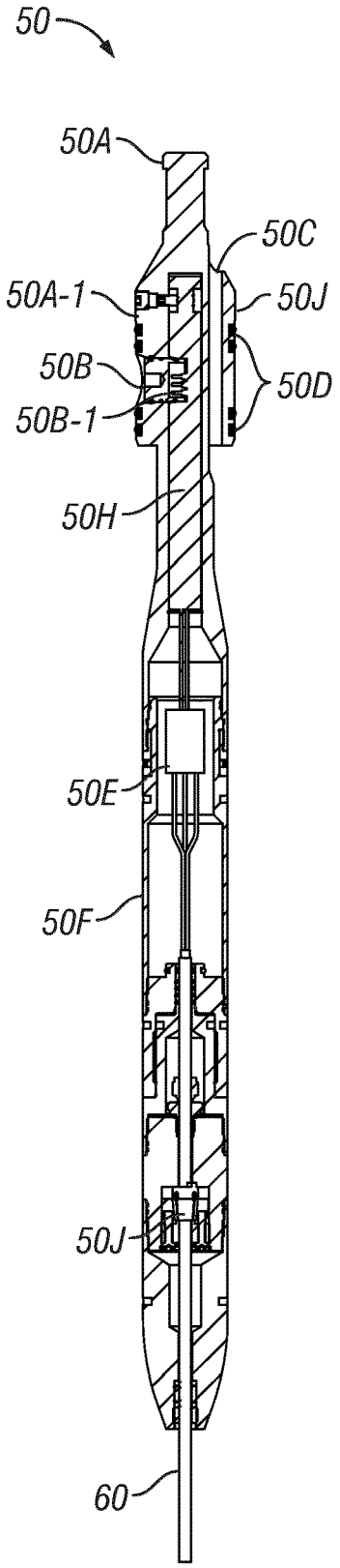
FIGS. 3A, 3B and 3C show various views of a cable hanger.
Figure 3B:
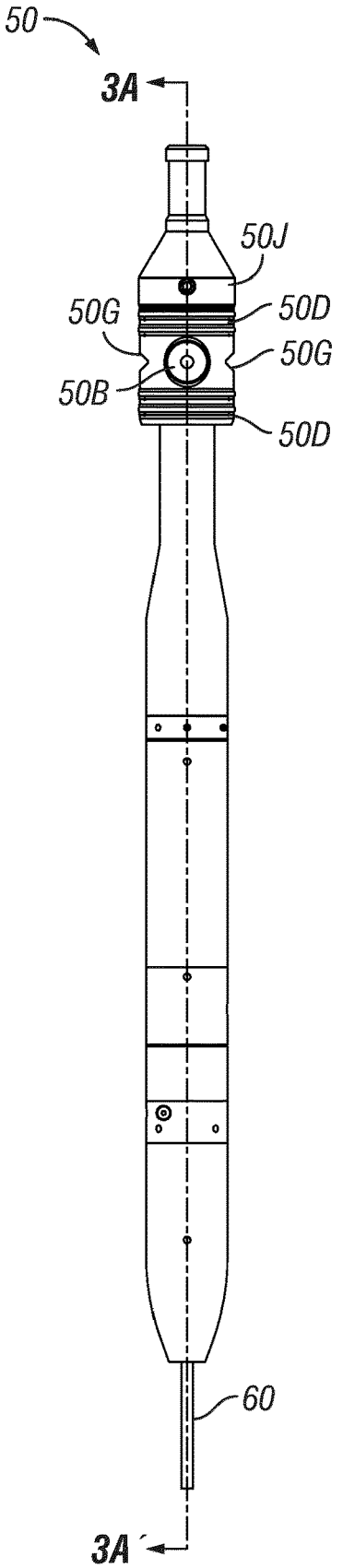
Figure 3C:
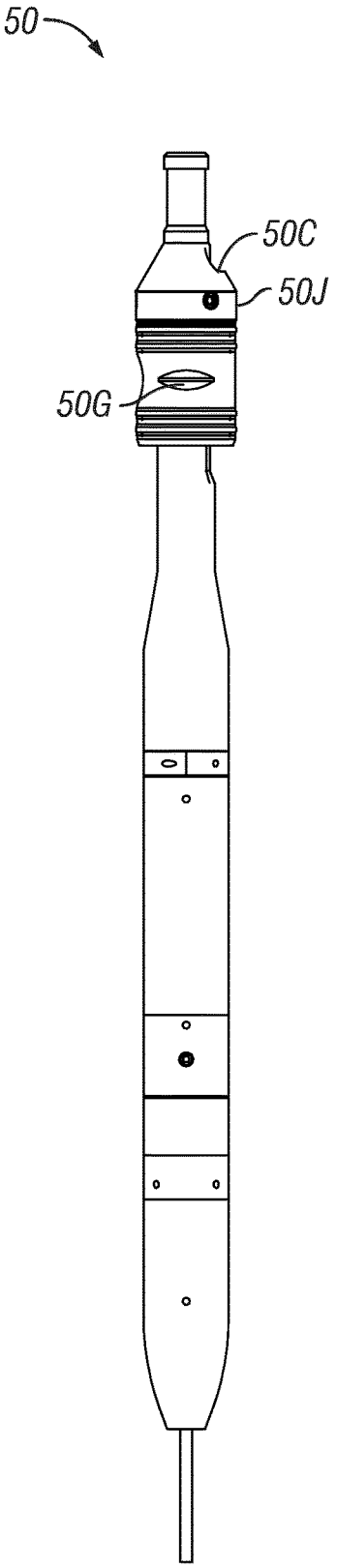

In FIG. 3B, a view of the cable hanger 50 rotated 90 degrees from the view in FIG. 3A shows the blanking plug 50B and the seals 50D. FIG. 3B also shows lockdown profiles 50G approximately in the longitudinal center of the seal section 50A-1 that provide an engagement surface for the lockdown screws (54 in FIG. 2B). Thus, when the lockdown screws (54 in FIG. 2B) are fully inserted, the seal section 50A-1, and thereby, the remainder of the cable hanger 50, are retained in the valve body (30A in FIG. 2A). A view rotated further 90 degrees as shown in FIG. 3C provides an example shape for the lockdown profile 50G and more clearly shows the shoulder 50J and the flow port 50C.

Figure 4A:
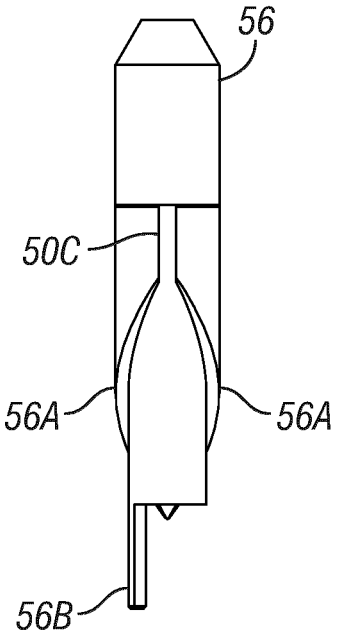
FIGS. 4A, 4B and 4C show various views of an orienting section of a running tool.
Figure 4B:
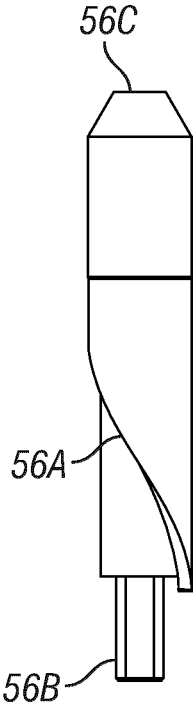
Figure 4C:
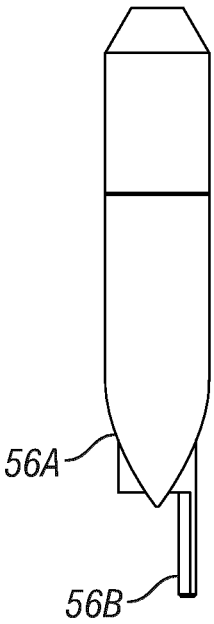

It will be appreciated that the cable hanger 50 should be rotationally oriented in the seal area (30B-1 in FIG. 2A) in a particular direction in order for the electrical contacts 50B-1 and the lockdown profile 50G to be operable as described above. Referring to FIGS. 4A, 4B and 4C, an example of an orienting tool 56 for the cable hanger (50 in FIG. 3A) will be explained. The orienting tool 56 may be affixed to the fishing neck (50A in FIG. 3A) using any known device enabling later release after setting the cable hanger (50 in FIG. 3A) in the seal area (30B-1 in FIG. 2A). Thus, once the cable hanger (50 in FIG. 3A) is seated in the seal area (30B-1 in FIG. 2A) and the lockdown screws (54 in FIG. 2B) are inserted, the orienting tool 56 may be released from the cable hanger (50 in FIG. 3A) by, e.g., upward pull on a cable, conduit, slickline or other running conveyance coupled to the orienting tool 56. Depending on the manner of conveyance, the orienting tool 56 may be removed by downward force. The orienting tool 56 may comprise on its exterior surface one or more helically shaped orienting "tulips" that engage the orienting screw (52 in FIG. 3B) when inserted such that axial movement of the orienting tool 56 through the valve body (30A in FIG. 3A) rotates the orienting tool 56 such that an orienting slot 56C engages the orienting screw (52 in FIG. 3B). Thus, the cable hanger (50 in FIG. 3A) is constrained to be in only one rotary orientation. To further stabilize the rotary orientation of the cable hanger (50 in FIG. 3A) the orienting tool 56 may further comprise an alignment pin 56B shaped to fit within the flow port (50C in FIG. 3C) when the cable hanger is attached to the orienting tool 56. The flow port (50C in FIG. 3C) will be reopened when the orienting tool 56 is removed from the cable hanger (50 in FIG. 3A). Corresponding views of the orienting tool 56 rotated 90 degrees from the view in FIG. 4A may be observed in FIG. 4B, and rotated a further 90 degrees in FIG. 4C to better understand possible shapes of the orienting tulips 56A and alignment pin 56B.

Figure 5B:
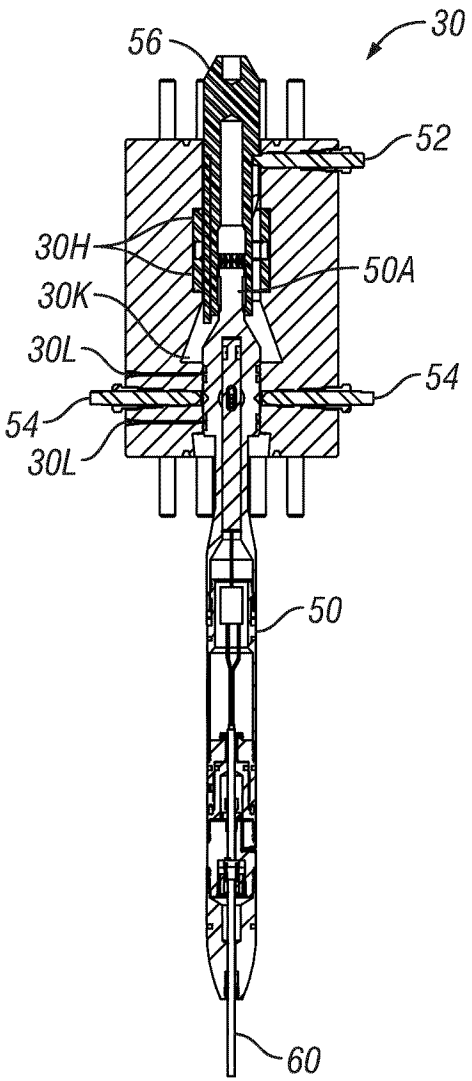
FIGS. 5A and 5B show views of the cable hanger in FIGS. 3A, 3B and 3C seated in the master valve of FIGS. 2A, 2B and 2C.
Figure 5A:
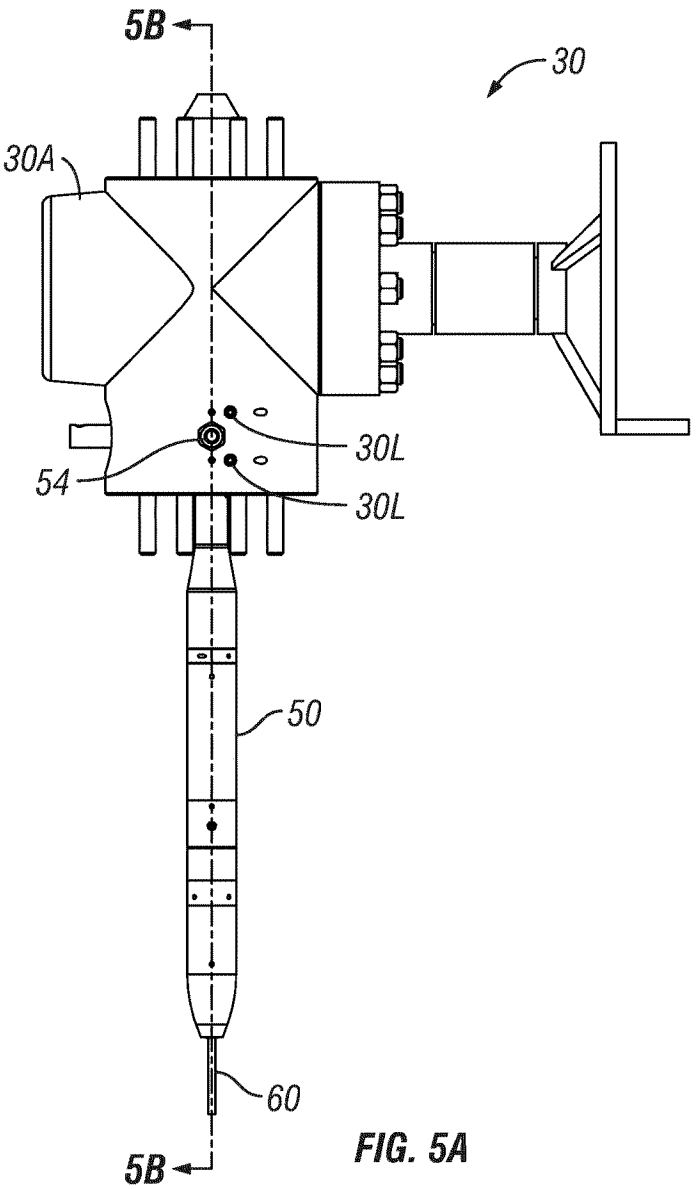

FIGS. 5A and 5B show, respectively, a side view, and a cross-section rotated 90 degrees therefrom, of the cable hanger 50 and the orienting tool 56 when the cable hanger 50 is seated on the landing 30K and the lockdown screws 54 and orienting screw 52 are inserted. An operation to install a device in a well such as an ESP may begin by closing one or both of the master valves (28, 30 in FIG. 1). The tree adapter (14 in FIG. 1) may be removed, and a blowout preventer (BOP) coupled to the tree (10 in FIG. 1). A cable may be threaded through a wireline lubricator and coupled to an ESP or other device to be installed in the well. The lubricator may be coupled to the BOP and the device run to a selected depth in the well. A wireline ram on the BOP may be closed, any pressure in the lubricator relieved and the lubricator lifted. At such time the cable may be clamped to hang off in the BOP. The cable hanger 50 and orienting tool 56 may then be coupled to the free end of the cable 60 extending from the cable clamp on the BOP. A running tool adaptor may be coupled to the free end of the cable on a winch or reel, connected to the cable hanger 56 and tension reapplied to the cable. The cable clamp may then be removed and the lubricator reattached to the BOP. The wireline rams may then be opened. The cable 60 may then be unspooled so that the cable hanger 50 eventually seats on the landing (30K in FIG. 3A). The cable may then be withdrawn a set distance to allow insertion of the orientating screw 52. The cable may then be unspooled to land and orientate the cable hanger 50. At such time, the lockdown screws 54 may be inserted. The cable 60 may be withdrawn so as to apply enough tension or compression on the cable to release the orienting tool 56 from the fishing neck 50A. At this time, the orienting screw 52 may be withdrawn and at least the upper master valve (28 in FIG. 1) may be closed.

Figure 6B:
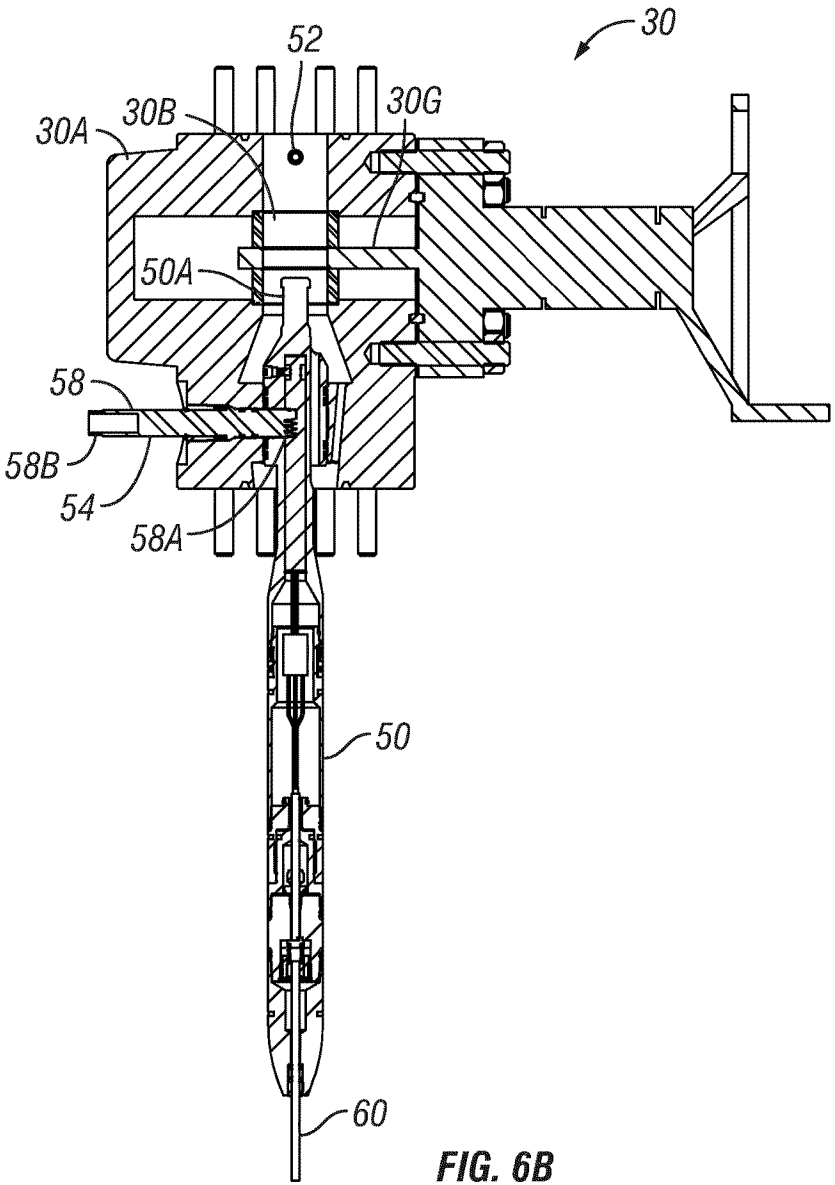
FIGS. 6A, 6B and 6C show views of the master valve with lockdown screws tightened and a side penetrator installed to effect electrical connection to an instrument along a cable such as an ESP.
Figure 6A:
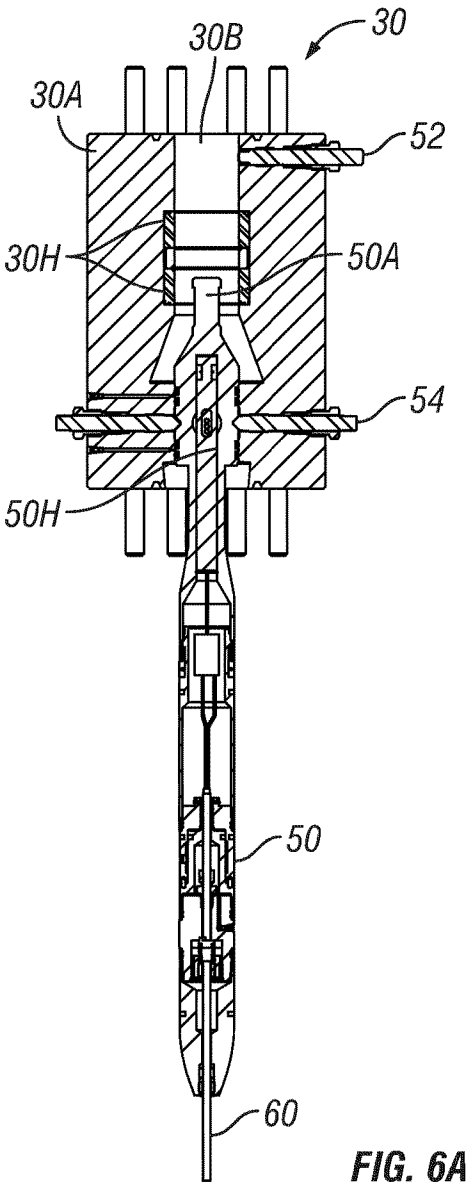
Figure 6C:
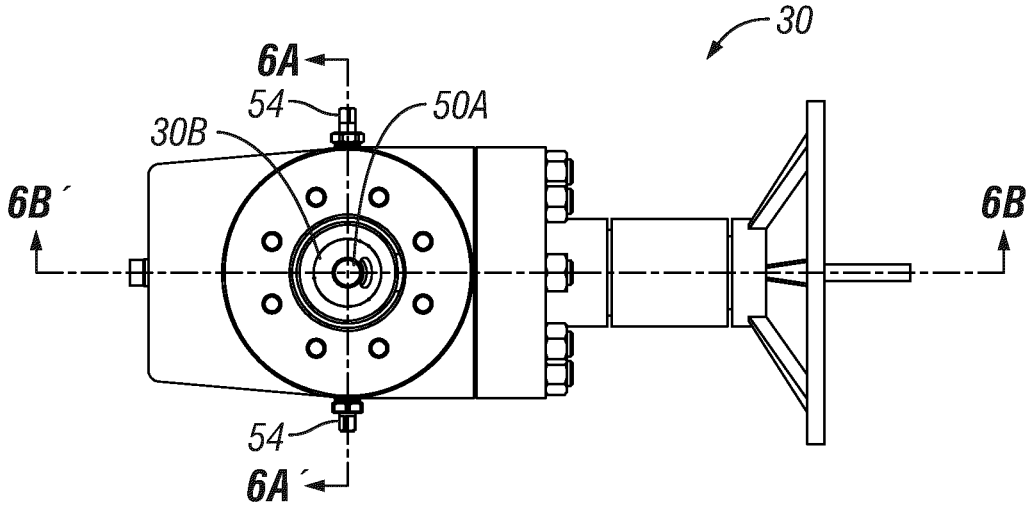

Once the cable hanger 50 is seated in the seal area (30B-1 in FIG. 2A), as explained above, the transverse bore (51A in FIG. 2A) is fluidly isolated. Pressure integrity may be tested by applying pressure to test ports in the lower master valve. It is then possible, and referring to FIGS. 6A, 6B and 6C, safely to remove the blanking plug (51 in FIG. 2A) from the transverse bore (51A in FIG. 2A), remove the running blanking plug (50B in FIG. 3A) from the cable hanger 50 and insert a horizontal penetrator 58 into the transverse bore (51A in FIG. 2A). The horizontal penetrator 58 may be shaped to sealingly engage the transverse bore (51A in FIG. 2A) and has electrical contacts 58A that engage the electrical contacts (50B-1 in FIG. 3A) in the vertical penetrator 50H in FIG. 3A). An electrical pigtail 58B may be provided at the other end of the horizontal penetrator to enable electrical connection to the one or more electrical conductors in the cable 60.

Referring once again to FIG. 1, the foregoing description of a method for installing a well tool such as an ESP is based on the tree 10 already having a lower master valve 30 made as explained with reference to FIGS. 2A, 2B and 2C. It should be understood that such lower master valve 30 as explained with reference to FIGS. 2A, 2B and 2C may be retrofit to an existing tree on a well having a conventional lower master valve in order to install a lower master valve as described herein and to install a well tool as explained above. In such cases, additional procedures are needed to retrofit the conventional lower master valve.

First, the existing master valves 28, 30 may be closed, any fluid pressure in the tree bled off, the well cap 14 removed and a lubricator and BOP may be attached to the swab valve 16. The lubricator may have a well plug or back pressure valve disposed therein, connected to a deployment line such as cable or slickline, and such cable or slickline may enter the top of the lubricator using any well-known form of moving cable (e.g., wireline or slickline) passthrough pressure seal. The master valves 28, 30 may then be opened and the plug or back pressure valve may be set in the well below the lower master valve 30. Such setting may be proximate the top of the production tubing, just below the tubing hanger. At this time, the lower master valve 30 may be uncoupled from the tree 10, and the tree 10 may be lifted to enable removal of the lower master valve 30. The lower master valve 30 may be replaced by a lower master valve as explained with reference to FIGS. 2A, 2B and 2C. The tree 10 may then be reassembled, and the procedure to install the well tool, e.g., an ESP, may continue as explained above.

Figure 7A:
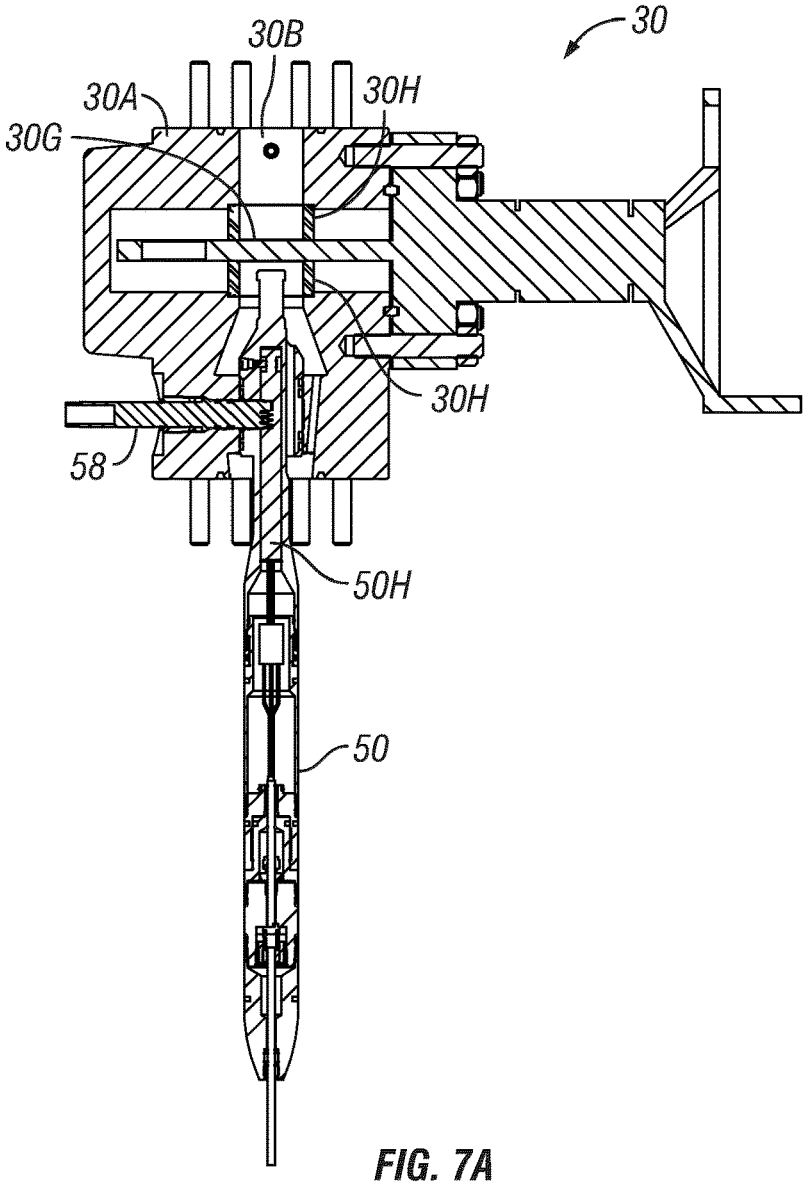
FIGS. 7A and 7B show views of the master valve with a side penetrator installed to effect electrical connection to an instrument along a cable such as an ESP. The valve is closed to isolate the well from the surface.
Figure 7B:
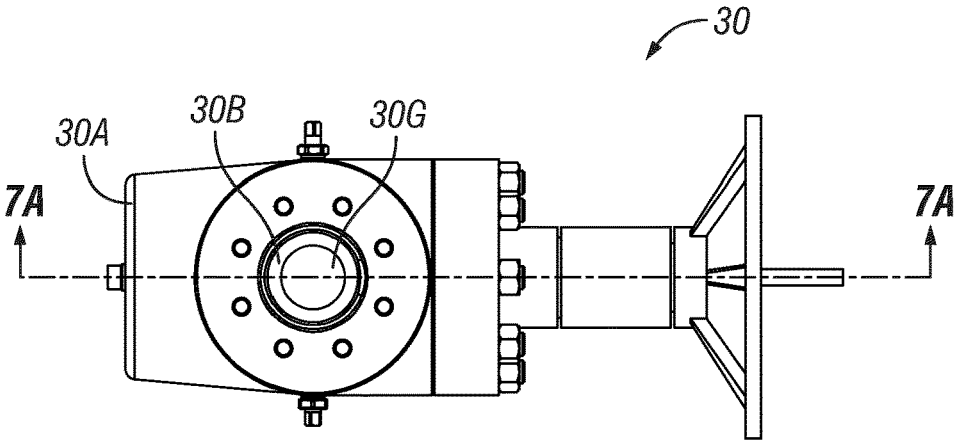

FIG. 7A shows side a cross-section view, and FIG. 7B shows a corresponding top view of the lower master valve 30 being closed after the cable hanger 50 is fully seated and the horizontal penetrator 58 is connected to the vertical penetrator 50H. The gate 30H may be observed as traversing the through bore 30B in the valve body 30A and sealing against the gate seats 30H. Thus, using a lower master valve 30 according to the present disclosure it is possible to close the well at the lower master valve 30, for example, to service tree and other well components above the lower master valve 30.

Figure 8:
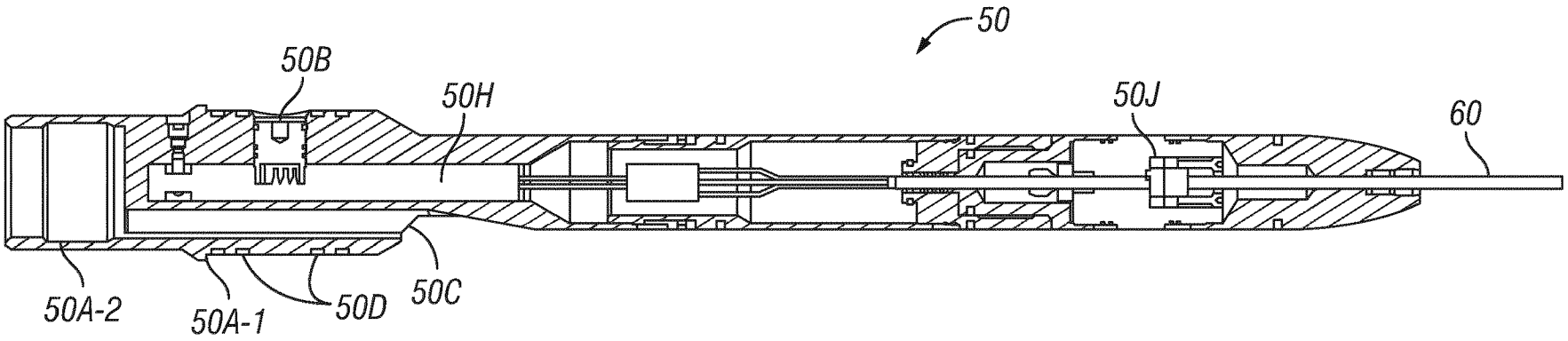
FIG. 8 shows another example of a cable hanger.

FIG. 8 shows another cable hanger 50 having an internal profile 50A-2 at its upper end instead of a fishing neck as in FIG. 3A. The internal profile 50A-2 may be used to run the cable hanger 50. The internal profile, and thus the lack of a fishing neck, may reduce the required height of the lower master valve (30 in FIG. 2A) such that the lower master valve (30 in FIG. 2A) may be used to directly replace a conventional well tree master valve.

A master valve, cable hanger and orienting tool according to the present disclosure may facilitate installing and servicing devices in a well without the need to kill the well, and may facilitate making electrical connection through a well tree to such devices in the well without the need for a specialized tree structure. The master valve disclosed herein may be retrofit to existing trees to provide such additional functionality without the need for extensive redesign or refit.

In light of the principles and examples described and illustrated herein, it will be recognized that the examples described can be modified in arrangement and detail without departing from such principles. Accordingly, all such modifications are intended to be included within the scope of this disclosure as defined in the following claims. The foregoing discussion has focused on specific examples, but other configurations are also contemplated. In particular, if expressions such as in "an embodiment," or the like are used herein, these phrases are meant to generally reference embodiment possibilities, and are not intended to limit the disclosure to particular embodiment configurations. As used herein, these terms may reference the same or different embodiments or examples that are combinable into other embodiments or examples. As a rule, any embodiment or example referenced herein is freely combinable with any one or more of the other embodiments or examples referenced herein, and any number of features of different embodiments or examples are combinable with one another, unless indicated otherwise.

The invention claimed is:

1. A valve and cable hanger system for deploying and making electrical connection to a well tool, comprising:

a valve body having a through bore;

a valve closure element arranged to close the through bore;

a landing for a cable hanger in the through bore to one side of the valve closure element, the landing comprising a seal area and a bore transverse to the through bore penetrating into the seal area;

the cable hanger comprising a seal section having longitudinally spaced apart seals engageable with an interior surface of the seal area, the seal section having electrical contacts disposed between the seals, the seal section comprising a lockdown profile;

at least one flow port arranged to bypass the seal section, the at least one flow port penetrating at least one of the seal section and the seal area;

at least one lockdown screw disposed within the valve body so as to penetrate the seal area between the seals and engage the lockdown profile; and a blanking plug disposed in the transverse bore to seal the seal area prior to insertion of the cable hanger.

2. The system of claim 1 further comprising an orienting tool coupled to one end of the cable hanger, the orienting tool comprising at least one helically shaped orienting tulip.

3. The system of claim 2 further comprising an orienting screw disposed within the valve body an extending into the through bore on a side of the valve closure element opposed to the seal area, the orienting screw extending into the through bore to engage the at least one orienting tulip.

4. The system of claim 2 wherein the at least one flow port is disposed in the valve body proximate the seal area, the orienting tool further comprising an orienting pin shaped to engage the at least one flow port in the valve body.

5. The system of claim 2 wherein the orienting tool is coupled to the cable hanger by a release mechanism enabling disengagement of the orienting tool from the cable hanger.

6. The system of claim 5 wherein the release mechanism comprises a device having a selected failure tension or compression.

7. The system of claim 1 further comprising a penetrator having electrical contacts at one end and sealingly disposable within the transverse bore, the electrical contacts engageable with the electrical contacts in the seal section.

8. The system of claim 1 wherein the valve closure element comprises a valve gate and gate seats.

9. A method for installing well tool in a well, comprising:

installing a plug, or plugs, in the well below a well tree;

closing an upper master valve and a lower master valve on the well tree;

replacing the lower master valve with a replacement master valve, the replacement master valve having a landing for a cable hanger in a through bore to one side of a valve closure element, the landing comprising a seal area and a bore transverse to the through bore penetrating into the seal area;

opening the upper master valve;

removing the plug; and extending the well tool into the well on an end of an electrical cable;

affixing the cable hanger to the electrical cable and seating the cable hanger in the seal area, the cable hanger comprising sealing elements to engage the seal area and an electrical connector, the electrical connector oriented to enable access through a horizontal bore in the seal area.

10. The method of claim 9 wherein the sealing elements on the cable hanger close the transverse bore to fluid flow when the cable hanger is disposed in the seal area.

11. The method of claim 9 wherein the installing the plug, extending the well tool into the well and the affixing the cable hanger are performed by affixing a blowout preventer and lubricator to the well tree after closing the upper master valve.

12. The method of claim 9 further comprising inserting a packer into the well after removing the plug and prior to extending the well tool.

13. The method of claim 9 wherein the electrical cable comprises a tubing encapsulated cable.

14. The method of claim 9 further comprising making electrical connection to the electrical connector and operating the well tool.

15. The method of claim 9 further comprising affixing at least one of a plug and a back pressure valve in a profile in an upper one of the gate seats, the upper one of the gate seats disposed in a through bore in the master valve.

* * * * *